United States Patent [19]

Lockwood et al.

[11] 4,245,535

[45] Jan. 20, 1981

[54] PORTABLE SAWMILL AND METHOD FOR CUTTING LOGS

[76] Inventors: Larry D. Lockwood, 1939 SW. Linnell; Lawrence D. Lockwood, Rte. 4, Box 913, both of Roseburg, Oreg. 97470

[21] Appl. No.: 929,034

[22] Filed: Jul. 28, 1978

[51] Int. Cl.[3] ..... B27B 17/02; B27B 1/00

[52] U.S. Cl. ..... 83/798; 83/799; 83/800; 83/708; 83/36; 83/795

[58] Field of Search ..... 83/36, 794, 795, 796, 83/797, 798, 799, 800, 708

[56] References Cited

U.S. PATENT DOCUMENTS

| | | | |
|---|---|---|---|
| 824,009 | 6/1906 | Gray et al. | 83/799 |
| 2,669,261 | 2/1954 | Bowers et al. | 83/800 |
| 2,702,057 | 2/1955 | Miller . | |
| 3,695,316 | 10/1972 | Pluckhahn | 83/794 |
| 3,747,455 | 7/1973 | Hartzell et al. | 83/708 |

FOREIGN PATENT DOCUMENTS

| | | | |
|---|---|---|---|
| 1032518 | 6/1958 | Fed. Rep. of Germany | 83/799 |

*Primary Examiner*—Donald R. Schran

*Attorney, Agent, or Firm*—Klarquist, Sparkman, Campbell, Leigh, Hall & Whinston

[57] ABSTRACT

A portable sawmill includes a log supporting mechanism for holding a substantially horizontal log. A chain saw with a substantially horizontal effective cutting edge at least as long as the log is supported at only one end by a saw mounting assembly with the cutting edge generally parallel to the axis of the log. The saw mounting assembly is adapted for lateral movement relative to the log, as well as upward and downward movement, so that the saw can be positioned beneath a portion of the log and moved upwardly through the log to cut wood slabs. The saw is pivoted to the saw mounting assembly so that the angle between the effective cutting edge and the axis of the log can be adjusted to produce elongated wood fibers during cutting. A pivoting mechanism is provided for rotating the log between cuts so that slabs tapered from one side to the other can be cut. The saw mounting assembly is also adapted for pivoting about a vertical axis to move the cutting edge out of a vertical plane parallel to the previous cut so that longitudinally tapered slabs can be sawn.

8 Claims, 2 Drawing Figures

PORTABLE SAWMILL AND METHOD FOR CUTTING LOGS

BACKGROUND OF THE INVENTION

1. Field of the Invention

The present invention relates to a portable sawmill and more particularly to a sawmill of the type employing a chain saw. In addition, the invention relates to a method of cutting logs in which the cutting edge of a chain saw is maintained substantially in alignment with the longitudinal axis of a log during cutting.

2. Description of the Prior Art

It is and has been common practice to leave large numbers of short and small logs behind at a logging site because it is not economically feasible to transport them to a sawmill. This material is typically burned as slash or simply allowed to rot. Devices have been made to salvage some of this otherwise lost wood at the logging site. In particular, various types of portable sawmills have been developed for transportation to a logging site for milling logs that otherwise would be left behind. Of these sawmills, only a few are known which utilize a chain saw for purposes of cutting lumber. In one device, shown in U.S. Pat. No. 3,695,316 of Pluckhahn, a portable timber milling jig includes a stationary beam for positioning parallel to and above a log. A chain saw carriage is mounted to the beam and can slide along the beam with the chain saw projecting downwardly for cutting slabs of wood from the log. As with other known chain sawmills, the cutting edge of the saw of this device is generally normal to the log being cut. Consequently, sawdust is produced during cutting and not more desirable elongated wood fibers. Furthermore, the Pluckhahn device lacks the capability of cutting slabs that are of non-uniform thickness.

Another portable chain sawmill device is described in U.S. Pat. No. 2,702,057 of Miller. In Miller, the chain saw cutting edge is held at an angle approaching normal to the log so that sawdust and not elongated fiber is produced during cutting. Also, Miller employs an overhead carriage along which the saw is moved from one end of the log to the other during cutting. Limitations in this sawmill interfere with the cutting of canted slabs from a log.

Therefore, a need exists for a portable chain sawmill which produces elongated fibers as usable by-products during cutting, and which has the flexibility of easily cutting lumber of uniform thickness or which is tapered as desired.

SUMMARY OF THE INVENTION

It is one object of the invention to provide an improved portable chain sawmill.

It is another object of the invention to provide an improved method of cutting logs with a chain saw.

Still another object of the invention is to provide an improved chain sawmill capable of producing slabs of wood which are of uniform thickness, or tapered as desired.

An additional object of the invention is to provide a portable chain sawmill which is durable, relatively maintenance free, and which is easily transportable to a remote logging site.

A further object of the invention is to provide a chain sawmill which produces elongated fibers during cutting, such fibers being baleable for such uses as animal bedding, packing material and ground cover.

A more specific object of the invention is to provide a chain sawmill having a substantially horizontal effective cutting edge mounted for upward movement through the log to saw slabs from the log.

Still another object of the invention is to provide a chain sawmill adapted for holding a log and for positioning a log during cutting as desired.

A further object of the invention is to provide a chain sawmill in which the angle between the effective cutting edge and the axis of a log is adjustable to enhance the cutting rate and improve the production of elongated wood fiber during cutting.

The foregoing and other objects, features and advantages of the invention will become more apparent from the following detailed description which proceeds with reference to the accompanying drawings.

DETAILED DESCRIPTION OF THE PREFERRED EMBODIMENT

Figure 1:
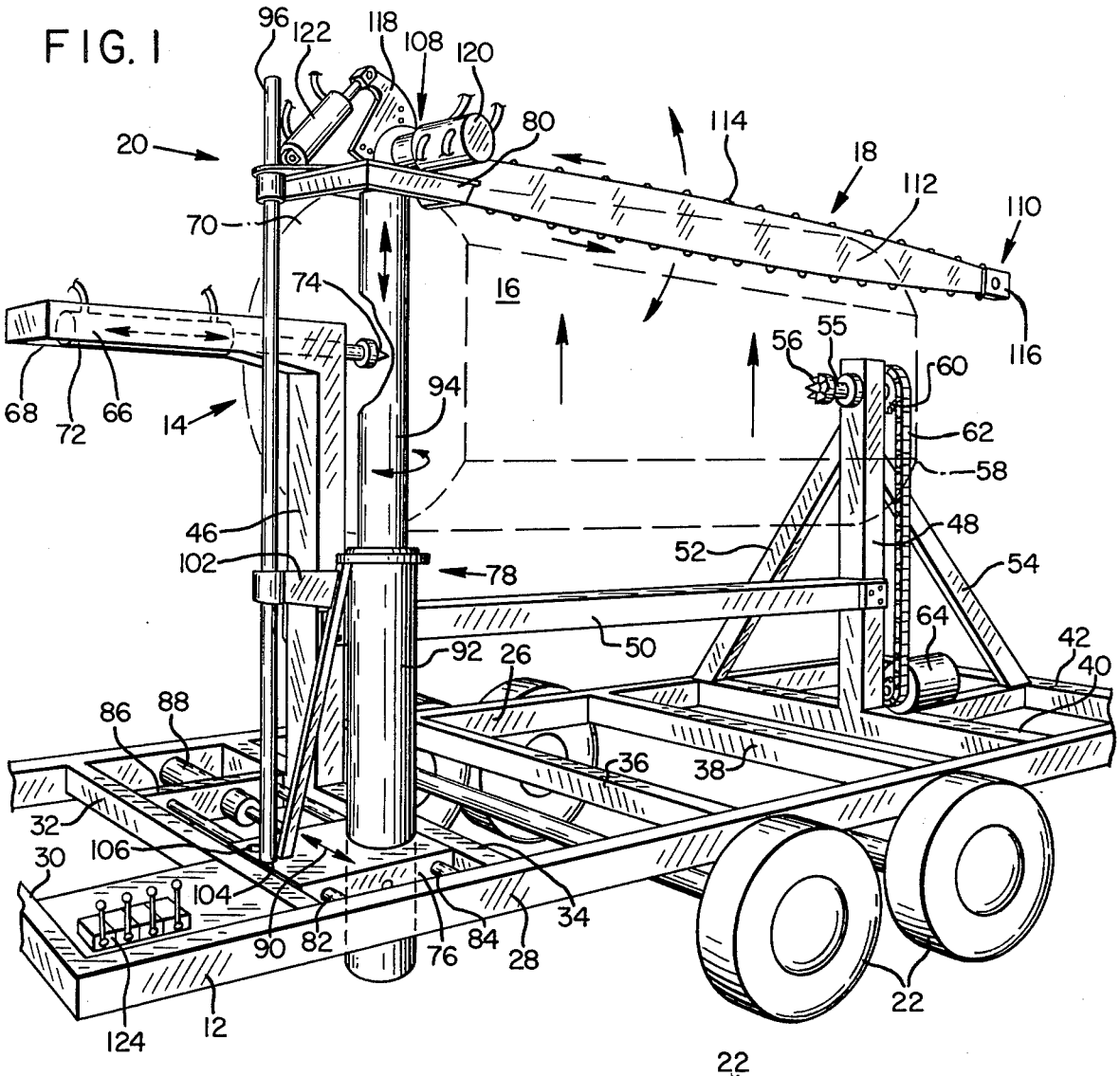
FIG. 1 is a perspective view of a preferred embodiment of a chain sawmill in accordance with the present invention.

With reference to the drawing, the portable sawmill of the present invention includes a trailer or frame 12 and a log holding assembly indicated generally at 14 for supporting a log 16 (shown in dashed lines) above the frame. A chain saw 18 is supported by a saw mounting mechanism 20 for cutting slabs of wood and producing elongated wood fiber from the log.

Figure 2:
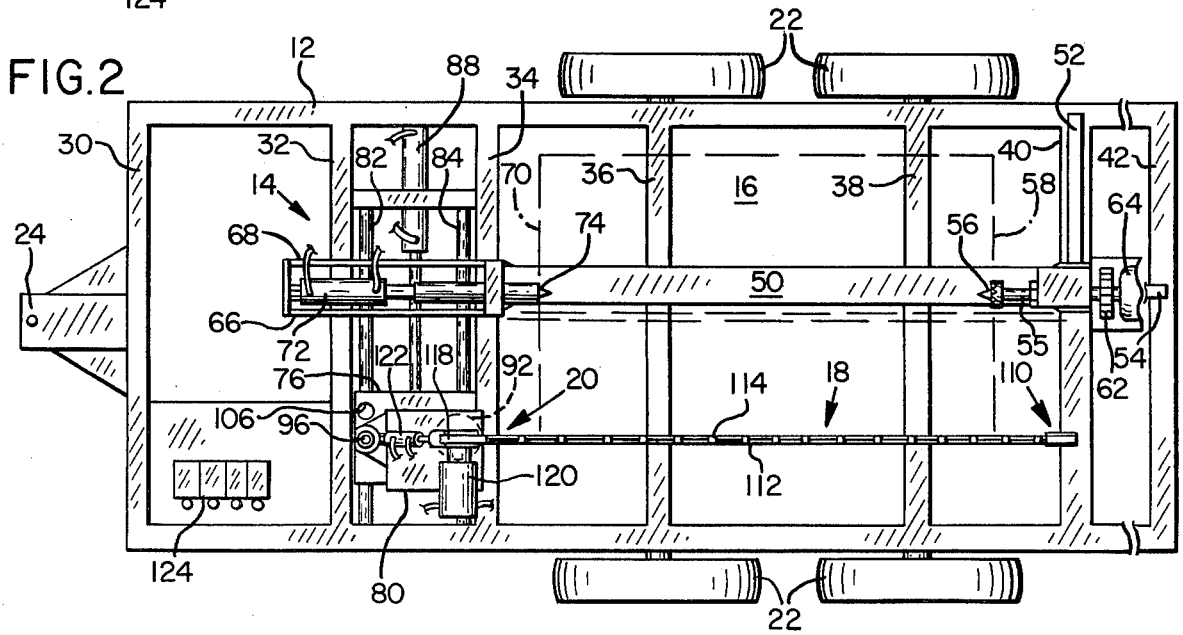
FIG. 2 is a top plan view of the sawmill of FIG. 1.

Frame 12 is carried by pairs of tandem wheels 22 and has a hitch 24 (FIG. 2) which can be connected to a truck so that the sawmill can readily be moved to remote logging sites. Frame 12 is rectangular with a generally horizontal bed formed by a pair of spaced apart parallel side rails 26, 28 connected together by a plurality of lateral cross rails 30 through 42. Preferably, these rails are of rigid steel to improve the durability of the sawmill.

Log holding assembly 14 includes a pair of rigid spaced apart vertically upright masts 46, 48 projecting from approximately the center of the respective cross rails 34, 40. A horizontal reinforcing bar 50 extends between these masts, approximately one-third of the way up the masts from the frame, to strengthen the construction. In addition, bracing members 52, 54, connected between the upper portion of mast 48 and frame 12, reinforce the log holding assembly. A shaft 55 extends through the upper end of mast 48 and carries a toothed prod 56 for gripping the outer end 58 of the log. Shaft 55 is pivoted to mast 48 and carries a gear 60 at its outer end coupled by a drive chain 62 to a hydraulic motor 64. A pair of parallel, spaced apart plates 66, 68 project perpendicularly from the upper end of mast 46 in a direction away from the inner end 70 of the log. A hydraulically operated cylinder 72, supported between plates 66, 68, carries a pointed ram 74 at the end of its piston rod for engaging end 70 of the log. When a log is positioned between masts 46, 48, cylinder 72 is actuated to impale the inner end of the log 70 with ram 74 and force the outer end 58 of the log against prod 56. Consequently, operation of motor 64 causes rod 54, and hence the log, to pivot with the tip of ram 74 acting as a pivot point.

Saw mounting mechanism 20 includes a lower platform 76 carrying a vertical lift 78 which in turn supports an upper platform 80. Platform 76 is slidably mounted to a pair of parallel rods 82, 84 positioned between cross members 32, 34. Rods 82, 84 are each connected at one end to rail 28 and at their other end to a bracing member 86 extending between these cross members. A hydraulic cylinder 88 connected at one end to rail 26 and supported by member 86 has its piston rod connected to platform 76 for moving the platform along rods 82, 84. More specifically, cylinder 88 is double-acting for moving platform 76 in either direction along a line (indicated by arrow 90) normal to a plane bisecting the longitudinal axis of log 16. Furthermore, because they are supported by lower platform 76, lift 78 and upper platform 80 move with the movement of the lower platform.

Lift 78 includes a housing 92 and a sleeve 94. Sleeve 94 is connected at its upper end to platform 80 and is pivotable about the axis of housing 92. A double-acting hydraulic cylinder (not shown), positioned within the housing and sleeve, raises and lowers upper platform 80 with the sleeve 94 telescoping within housing 92 in a conventional manner. A cylindrical guidepost 96, parallel to and spaced from the longitudinal axis of lift 78, guides the upward and downward movement of platform 80. Guidepost 96 passes downwardly through a corner of upper platform 80, through one end of a bracing member 102, and has its lower end positioned within a recess 104 in the upper surface of lower platform 76. The other end of bracing member 102 is connected to housing 92. Guidepost 96 can be slid upwardly and downwardly. Thus, the lower end of guidepost 96 can be raised until it clears bracing member 102 to thereby permit pivoting of upper platform 80 about the vertical axis of lift 78. After such pivoting, guidepost 96 can then be lowered through another bore in bracing member 102 (not shown) until its lower end fits within another recess in the upper surface of lower platform 76, such as recess 106. When upper platform 80 is pivoted, chain saw 18 also pivots about the vertical axis of lift 78. As a result, following the cutting of a slab, the chain saw can be pivoted about this vertical axis so that the next slab is longitudinally tapered. That is, the slab is not as thick at one end as at the other. Furthermore, the chain saw can be pivoted so that it is positioned above logs lying beside the mill and then moved downwardly through such logs to cut slabs of wood and wood fiber therefrom.

Chain saw 18 has its inner end 108 supported by the upper surface of platform 80 while its outer end 110 is unsupported. The bar 112 of the chain saw is pivotally mounted on a bracket (not shown) which is secured to the upper surface of platform 80 so that the chain saw is thus cantilevered outwardly from platform 80. Furthermore, the bar 112 is positioned generally in a vertical plane, and when the lower end of guide-post 96 is in recess 104, the bar is parallel to the axis of the log. The chain saw bar 112, and hence the effective cutting edge of the saw provided by a chain 114 is longer than the log being cut. In the preferred embodiment, the bar is eleven feet long and about $\frac{1}{4}$ inch thick. In addition, the bar is five inches wide at each end and about twelve inches wide at its center. Surprisingly, even though the free end of the saw is unsupported, the saw does not wander during cutting. That is, the cutting edge remains in a vertical plane as each slab is sawn.

An Omark Industries' Model 11B-A chain having a $\frac{3}{4}$ inch pitch and a depth gauge which has been built up to zero and then filed back to a ten/ten-thousandths cut has been found suitable for use in the mill. This particular chain cuts a one-half inch kerf in the log. A conventional chain guard 116 is provided at the free end of the saw.

A hydraulic motor 120, mounted on platform 80, is operatively connected by a universal joint (not shown) to the chain saw for driving the chain. Preferably, motor 120 is operated to cause rotation of the chain in a counterclockwise direction so that fibers which result from cutting by moving the saw upwardly through the log are thrown out past the free end of the log. Because the free end of the saw is unsupported, the fibers are thrown clear without hanging up on any structure at this end of the saw. An ear plate 118, rigidly connected to the chain saw bar 112, is operated by a hydraulic cylinder 122 to pivot the bar, and hence the effective cutting edge, about a horizontal axis which is generally perpendicular to the axis of the log.

Operation of the various hydraulic cylinders and motors is accomplished in a conventional manner by conventional controls such as 124. Power for the mill is supplied in a known manner by a gas or diesel motor.

OPERATION OF THE PREFERRED EMBODIMENT

The sawmill is first moved to the site where logging, usually of logs left behind after a site has been logged, is desired. After reaching the site, a log is picked up and positioned with its longitudinal axis substantially horizontal, between ram 74 and prod 56. Actuation of cylinder 72 then causes the log to be held in position. In a prototype of our invention, logs of up to fifty inches in diameter can be held while slabs of up to thirty-six inches wide can be cut. Prior to mounting the log, the saw is lowered by lift 78 until the upper edge of the bar is beneath the position to be occupied by the log. Cylinder 88 thereupon moves platform 76 laterally to adjust the chain saw relative to the log to cut a slab of desired thickness. Prior to cutting, cylinder 122 pivots the chain saw downwardly until the angle between the plane containing the upper edge of chain 114 and the plane containing the axis of the log is approximately 15°. After positioning the saw, lift 78 raises the saw upwardly through the log to cut a slab. These slabs have a semi-planed surface instead of the more rough texture produced by cutting with a conventional chain saw.

It has been found that, by adjusting the angle of the cutting edge relative to the axis of the log to approximately 15°, the production of elongated fibers as a by-product of cutting is enhanced. Furthermore, the rate of cutting is improved by such an adjustment, and for fir logs, it has been found to be in the neighborhood of two feet per minute. These fibers are unusually long and reach a length of about four feet under certain conditions. Because of the counterclockwise rotation of the chain, these fibers are thrown outwardly beyond the free end 110 of the saw, thereby making them easy to gather. As a matter of fact, their unusual length makes them baleable for subsequent usage as animal litter, packaging material, ground cover and many other purposes. As a more specific example, during testing approximately ten cuts were made through a 30 inch diameter log. In addition to slabs, approximately three loose pack pickup loads of elongated fiber were produced.

Following one such cut, lift 78 is operated to lower the saw below the log, and platform 76 is then laterally adjusted to provide for the next cut. Thereupon the saw is moved upwardly through the log to produce a second slab of lumber. Although the sawmill is capable of cutting downwardly through a log, upward cutting has been found to produce faster and more accurate cuts.

It is often desirable to produce tapered planks, such as for lap siding. Consequently, following one cut, the log can be rotated by motor 64 so that the plane of the previous cut is no longer vertical. When the saw is moved upwardly through the log, the resulting slab will be narrower at one side than the other. Furthermore, slabs that are longitudinally tapered can be produced by moving the chain saw about the vertical axis of lift 78 between cuts. Consequently, the portable sawmill of the present invention has wide versatility in cutting logs.

Having illustrated and described the principles of our invention with reference to one preferred embodiment, it should be apparent to those persons skilled in the art that such invention may be modified in arrangement and detail without departing from such principles. We claim as our invention all such modifications as come within the true spirit and scope of the following claims.

We claim:

1. A portable sawmill for cutting slabs of wood from a substantially horizontal log, comprising:

a frame;

saw mounting means carried by said frame and adapted for upward and downward movement, said saw mounting means including rigid pivot means defining a generally horizontal saw pivot axis which is generally perpendicular to the longitudinal axis of the log;

means for moving said saw mounting means upwardly and downwardly; and a chain saw having an effective cutting edge at least as long as the log, said chain saw being pivotally mounted at one end portion to said pivot means so as to pivot about said saw pivot axis and such that its cutting edge is substantially horizontal and positioned in a vertical plane substantially parallel to the longitudinal axis of the log so that upward and downward movement of said saw mounting means causes corresponding upward and downward movement of the cutting edge in the vertical plane, whereby a slab from a portion of the log positioned within the vertical plane is cut by the cutting edge when said saw mounting means moves; and saw pivoting means for pivoting said chain saw about said saw pivot axis to adjust the angle between the effective cutting edge and a generally horizontal plane containing the longitudinal axis of the log.

2. A portable sawmill according to claim 1 in which said saw pivoting means comprises means for adjusting said angle to approximately fifteen degrees.

3. A portable sawmill according to claim 1 in which said means for moving said saw mounting means comprises an elongated upright rigid lift means for rigidly supporting said saw mounting means, said lift means being pivotal about a vertical axis, and including means for pivoting said lift means about said vertical axis to thereby pivot said saw mounting means and chain saw about said vertical axis, whereby following the sawing of one slab said chain saw can be pivoted about said vertical axis so that it is no longer parallel to the previously sawn surface of the log so that a longitudinally tapered slab can be subsequently sawn.

4. A portable sawmill comprising:

a frame;

log holding means mounted to said frame for holding a log, said log holding means comprising first and second upright spaced apart masts, a prod pivoted to the first of said masts and positioned for engaging one end of a generally horizontal log positioned between said masts, a hydraulic ram mounted to the second mast for engaging the other end of the log at a location generally opposite to said prod and for urging said one end of the log into engagement with said prod, and means for pivoting said prod to cause said log to pivot about a pivot axis passing through said prod and said ram;

chain saw mounting means including a lower platform mounted to said frame for movement laterally along a line perpendicular to a vertical plane containing said pivot axis toward and away from the log, a lift projecting vertically upwardly from said lower platform, an upper platform supported by the upper end of said lift, said lift being operable to raise and lower said upper platform between positions, a guidepost spaced apart from said lift and projecting upwardly from said lower platform through an opening in said upper platform so that said upper platform slides in contact with said guidepost to thereby guide its movement when said upper platform is moved between positions;

a chain saw having one end mounted to said upper platform and an unsupported free end and an effective cutting edge at least as long as the log, said chain saw being mounted primarily longitudinally of and edgewise to the log for cutting in a vertical plane and such that when said upper platform is in one position said cutting edge is positioned below the log and when said upper platform is in another position said cutting edge is positioned above the log;

means for laterally moving said lower platform so that, with said upper platform in said one position, said lower platform can be moved toward the log to thereby position the cutting edge of said saw for cutting in a vertical plane intersecting a portion of the log, whereby operating said lift to move said upper platform to said another of said positions raises the cutting edge upwardly through the log, thereby cutting a slab of wood from the log, and whereby pivoting said log following the cutting of said slab causes the surface of the log from which said one slab was cut to move out of a vertical plane so that a canted next slab can be cut.

5. A portable sawmill according to claim 4 in which said chain saw is pivotally mounted to said upper platform for movement about a horizontal saw pivot axis generally perpendicular to said log, and which includes means for pivoting said saw about said saw axis to cause said cutting edge to engage said log at an angle approximately fifteen degrees from horizontal to facilitate production of elongated fiber during cutting.

6. A portable sawmill according to claim 5 in which said frame includes a pair of horizontal spaced apart platform support rods which are parallel to the line of movement of said lower platform, said lower platform being slidably mounted to said rods, and in which said means for moving said platform comprises a hydraulic cylinder connected between a portion of said frame and said lower platform and operable to slide said lower platform along said rods.

7. A portable sawmill for cutting slabs of wood from a substantially horizontal log comprising:

a frame:

a chain saw mounting means connected to said frame and disposed adjacent one end of the log;

a chain saw mounted at one end portion to said chain saw mounting means and having an effective cutting edge at least as long as the log, said chain saw being mounted with its cutting edge positioned primarily longitudinally of and edgewise to the log;

said chain saw mounting means including means for moving said cutting edge in one plane through said log to cut slabs from the log;

said chain saw mounting means also including a chain saw mounting portion which supports said chain saw, a lift support member operatively mounted to said frame for lateral movement in a direction generally perpendicular to a vertical plane through the longitudinal axis of the log, means for laterally moving said lift support member, and in which said means for moving said cutting edge comprises an upright elongated lift member carried by said lift support member and connected at an upper end portion to said chain saw mounting portion, said lift being operable to raise and lower said chain saw mounting portion to thereby raise and lower the cutting edge in a generally vertical plane through the log, whereby lateral movement of said lift support member following the cutting of one slab causes lateral movement of the lift and positions the cutting edge for cutting a second slab;

said lift member being pivoted to said support member so as to pivot about a generally vertical axis and being rigidly connected to said chain saw mounting portion, such that pivoting said lift member about said vertical axis following the cutting of a first slab enables the cutting of a second slab which is tapered from one end to the other; and said chain saw mounting portion including a rigid pivot means defining a generally horizontal saw pivot axis which is generally perpendicular to the longitudinal axis of the log, said chain saw being pivoted at one end portion to said pivot means for pivoting about said saw pivot axis, and including means for pivoting said chain saw about said saw pivot axis to adjust the angle between the cutting edge and a generally horizontal plane.

8. A portable sawmill according to claim 7 in which said frame includes at least two elongated parallel spaced apart rods extending in the lateral direction adjacent said one end of the log, said lift support member comprises a lower platform slidably mounted to said rods, said lift member comprises a vertical lift and a vertical guidepost spaced from said lift;

said guidepost having an upper end portion slidably connected to said chain saw mounting portion, a lower end portion disposed in a first recess in the upper surface of the lower platform when said lift and thus the cutting edge is in a first position, said lower end portion being disposed in a second such recess when said lift and thus the cutting edge is pivoted about the vertical axis to a second position, and such that said guidepost guides the raising and lowering of the cutting edge when said lift is in said first and second positions.

* * * * *